US006949748B2

(12) United States Patent
Ziock et al.

(10) Patent No.: US 6,949,748 B2
(45) Date of Patent: Sep. 27, 2005

(54) BIOMEDICAL NUCLEAR AND X-RAY IMAGER USING HIGH-ENERGY GRAZING INCIDENCE MIRRORS

(75) Inventors: Klaus-Peter Ziock, Livermoe, CA (US); William W. Craig, Pittsburg, CA (US); Bruce Hasegawa, South San Francisco, CA (US); Michael J. Pivovaroff, Piedmont, CA (US)

(73) Assignee: The Regents of the University of California, Oakland, CA (US)

( * ) Notice: Subject to any disclaimer, the term of this patent is extended or adjusted under 35 U.S.C. 154(b) by 283 days.

(21) Appl. No.: 10/411,854

(22) Filed: Apr. 11, 2003

(65) Prior Publication Data

US 2003/0194054 A1 Oct. 16, 2003

Related U.S. Application Data

(60) Provisional application No. 60/373,192, filed on Apr. 16, 2002.

(51) Int. Cl.[7] ..... G21K 5/00
(52) U.S. Cl. ..... 250/370.01; 378/64
(58) Field of Search ..... 250/370.01, 505.1; 378/62, 84, 145

(56) References Cited

U.S. PATENT DOCUMENTS

| | | | | | |
|---|---|---|---|---|---|
| 5,497,008 | A | * | 3/1996 | Kumakhov | 250/505.1 |
| 5,604,782 | A | * | 2/1997 | Cash, Jr. | 378/85 |
| 5,745,547 | A | * | 4/1998 | Xiao | 378/145 |
| 6,271,534 | B1 | * | 8/2001 | Kumakhov | 250/505.1 |
| 6,359,963 | B1 | | 3/2002 | Cash | |
| 6,483,892 | B1 | * | 11/2002 | Wang et al. | 378/43 |
| 6,594,337 | B1 | * | 7/2003 | Silver et al. | 378/85 |
| 6,754,304 | B1 | * | 6/2004 | Kumakhov | 378/45 |
| 2001/0038680 | A1 | * | 11/2001 | Davidson | 378/43 |

FOREIGN PATENT DOCUMENTS

WO WO 02/16965 A2 2/2002

* cited by examiner

*Primary Examiner*—David Porta
*Assistant Examiner*—Faye Polyzos
(74) *Attorney, Agent, or Firm*—Michael C. Staggs; Alan H. Thompson

(57) ABSTRACT

Imaging of radiation sources located in a subject is explored for medical applications. The approach involves using grazing-incidence optics to form images of the location of radiopharmaceuticals administered to a subject. The optics are "true focusing" optics, meaning that they project a real and inverted image of the radiation source onto a detector possessing spatial and energy resolution.

75 Claims, 7 Drawing Sheets

BIOMEDICAL NUCLEAR AND X-RAY IMAGER USING HIGH-ENERGY GRAZING INCIDENCE MIRRORS

RELATED APPLICATION

This application claims the benefit of U.S. Provisional Application No. 60/373,192, filed Apr. 16, 2002, and entitled, "A Biomedical Nuclear and X-ray Imager Using High-Energy, Grazing incidence Mirrors," which is incorporated herein by reference.

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to a system and method for use in biomedical research and nuclear medicine. More specifically, the present invention provides a radionuclide imaging method and apparatus to produce high-resolution images of the structure and function in small animals.

2. State of Technology

The demand for noninvasive methods to evaluate structure and function in small animals have driven researchers to adapt diagnostic imaging technologies commonly used for humans to make these technologies available for mice. Techniques to evaluate structure in small animals include magnetic resonance imaging, ultrasound, computed tomography (CT), as well as conventional x-ray imaging.

Background information on a micro CT apparatus (i.e., MicroCat) for imaging mice is described in, "A New X-ray Computed Tomography System for Laboratory Mouse Imaging," by M. J. Paulus, H. Sari-Sarraf, S. S. Gleason, M. Bobrek, and D. K. Hicks, IEEE transactions On Nuclear Science, Vol. 46, No. 3, pp. 558–564, (1999), which provides the following description: "Two versions of a new high-resolution x-ray computed tomography system are being developed to screen mutagenized mice . . . . The first prototype employs a single-pixel cadmium zinc telluride detector with a pinhole collimator operating in a pulse counting mode. The second version employs a phosphor screen/CCD detector operating in a current mode. The major system hardware includes a low-energy x-ray tube, two linear translation stages and a rotation stage."

Functional assessments of physiology and metabolism are typically performed with nuclear imaging of radiopharmaceuticals, including positron computed tomography (PET), variants of PET (e.g., MicroPET), and single-photon emission computed tomography (SPECT). Metabolic and functional in vivo imaging also can be performed using magnetic resonance spectroscopy and optical imaging of fluorescence or luminescent molecules.

Background information on PET is described in, "Development of a Small Animal PET Imaging Device with Resolution Approaching 1 mm," by J. A. Correria, C. A. Burnham, D. Kaufman, and A. J. Fischman, IEEE transactions On Nuclear Science, Vol. 46, No. 3, pp. 631–635, (1999), which provides the following description: "The work presented here describes progress in the design and construction of a single-plane PET tomography having spatial resolution approaching 1 mm. The system consists of a 12 cm diameter ring with 360 LSO detectors viewed by 30 photo-multiplier tubes."

Background information on MicroPET is described in, "A High Resolution PET Scanner for Imaging Small Animals," by S. R. Cherry, Y. Shao, et al., IEEE transactions On Nuclear Science, Vol. 44, No. 3, pp. 1161–1166, (1997), which provides the following description: "It is also important to acknowledge that PET will never approach the fine resolution (~100 $\mu$m) attainable with autoradiography. However, much useful information can still be obtained at 1–2 mm resolution, particularly in biodistribution studies, organ function studies and tumor studies, and PET has the significant advantage of preserving the animal intact for measurements at a later time."

Background information on SPECT is described in, "ECG-Gated Pinhole SPECT in Mice with Millimeter Spatial Resolution," by Max C. Wu, et al., IEEE transactions On Nuclear Science, Vol. 47, No. 3, pp. 1218–1221, (2000), which provides the following description: "Biomedical researchers have long used animal models to investigate mechanisms and treatment of human diseases. While earlier methods of generating appropriate models were primarily limited to identification of a genetic anomaly or surgical or pharmacological interventions, transgenic and knockout techniques have produced animals in which genetic alterations precisely define the disease phenotype. Because of their genetic similarity to humans, short reproductive cycle, and general ease of care, mice are most often used as transgenic models. Unfortunately, a mouse's small size (about 15–40 grams) often precludes traditional physiological measurement techniques, and typical heart rates of around 600 beats per minute complicate cardiovascular phenotyping." The authors also state, "Radionuclide measurements of physiological functions in mice often are performed by tissue-counting or autoradiography, which requires sacrificing the animal."

Background information on an ultra-high resolution SPECT system is described in, "Ultra-high resolution SPECT system using four pinhole collimators for small animal studies," by K. Ishizu, et al., Journal of Nuclear Medicine, 36(12), pp. 2282–2286, (1995), which provides the following description: "The system utilizes a clinical four-head SPECT scanner with specially designed pinhole collimators . . . . The system provided a reconstructed spatial resolution of 1.65 mm (FWHM) and sensitivity of 4.3 kcps/micro Ci/ml with the best type of pinholes, respectively."

Therefore, a need exists for high-resolution imaging techniques that allow anatomical or functional information to be obtained non-invasively, so that each animal can be studied repeatedly. By such techniques, each animal can serve as its own control in studies with a longitudinal design. Some animal models (particularly those involving pharmacologic or surgical intervention) can exhibit high variability from one animal to another. Therefore, significant benefits are achieved if the experimental design allows the evolution of disease or therapy to be followed in an individual animal. Other animal models involve a large investment in time and expertise (particularly transgenic animals and study of gene therapy protocols) and researchers need tools such as that taught in the present invention that can non-invasively assess biological function.

Accordingly, the present invention provides an apparatus and method for noninvasive functional imaging to allow studies in small animals, such as, mice, that will advance our understanding of biology, including human growth, development, and disease.

SUMMARY OF THE INVENTION

Accordingly, the present invention provides an apparatus for imaging radiation sources by using grazing-incidence optics to form real and inverted images of the location of radiopharmaceuticals administered to a subject.

Another aspect of the present invention is to provide an apparatus for imaging radiation sources by using at least one-linear array of grazing-incidence optics to form real and inverted images on at least one detector of the location of radiopharmaceuticals administered to a subject.

Another aspect of the present invention is to provide an apparatus for imaging radiation sources by incorporating a low-resolution imaging detector to target the localized distribution of administered radiopharmaceuticals so that an imaging apparatus as taught in the present invention can produce high-resolution spatial images of the targeted radionuclides.

A further aspect of the present invention is to provide a non-invasive imaging method that includes: administering to a subject a radiopharmaceutical capable of emitting particles, directing the emitted particles with at least one grazing-incidence focusing optic, simultaneously detecting, with respect to a predetermined position between about 0 and about 360 degrees, each emitted x-ray and/or each emitted γ-ray captured by at least one detector; and producing high-resolution real and inverted images of the location of the radiopharmaceutical indicative of each of the predetermined positions.

Accordingly, the present invention provides a system and method for noninvasive functional imaging in small animals to allow studies in the development of new radiopharmaceuticals, assessment of new therapeutic approaches, and investigation of fundamental biological processes in transgenic and knockout mice. By providing high-resolution imaging of at least down to about 100 μm with grazing-incidence focusing optics, the present invention can advance our understanding of biology, including human growth, development, and disease.

BRIEF DESCRIPTION OF THE DRAWINGS

The accompanying drawings, which are incorporated into and form a part of the disclosure, illustrate an embodiment of the invention and, together with the description, serve to explain the principles of the invention.

DETAILED DESCRIPTION OF THE INVENTION

Figure 1A:
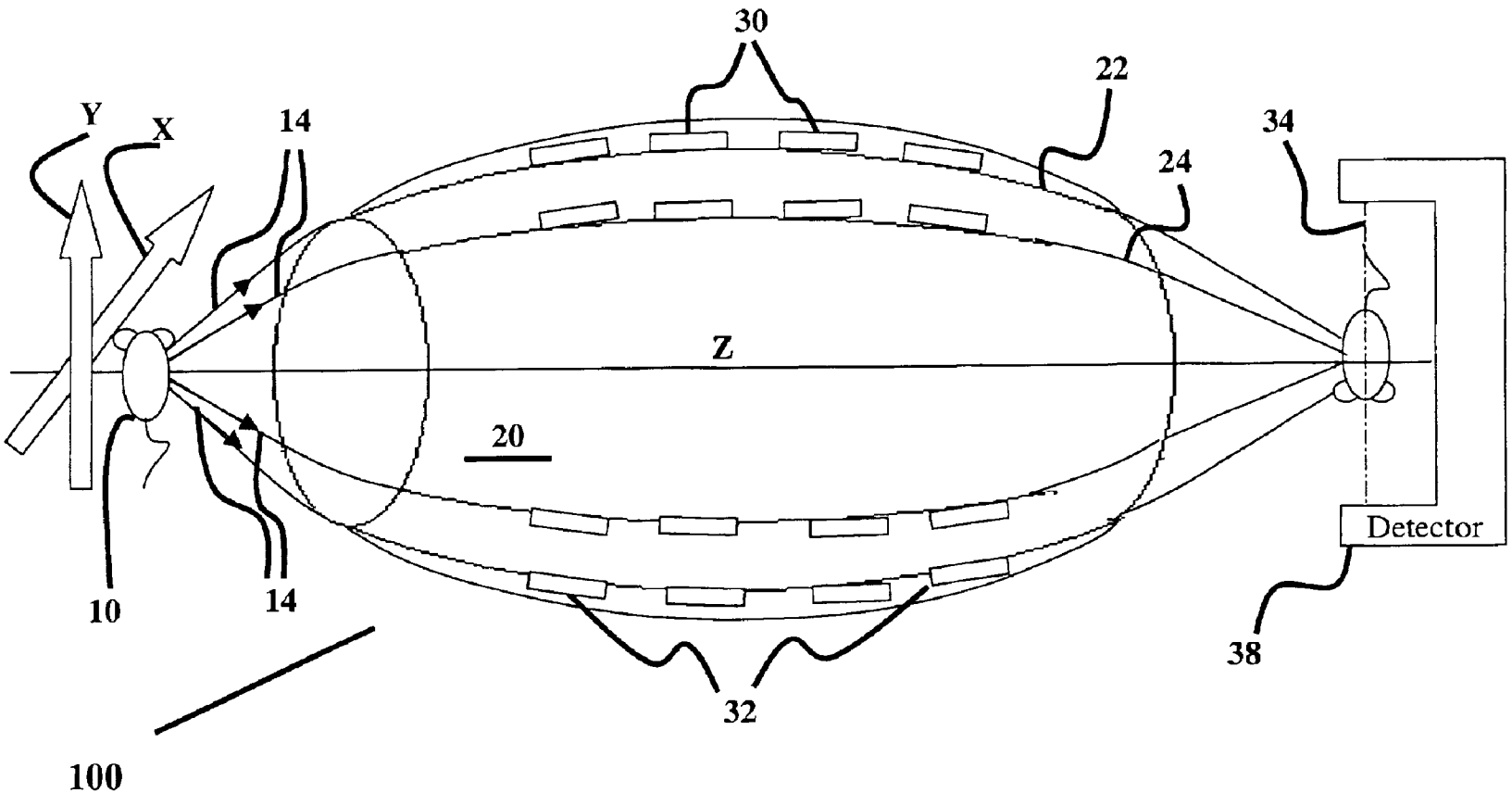
FIG. 1A shows a basic schematic of a near-field grazing-incidence mirror imager system.

Referring now to the following detailed information, and to incorporated materials; a detailed description of the invention, including specific embodiments, is presented. The detailed description serves to explain the principles of the invention.

Unless otherwise indicated, all numbers expressing quantities of ingredients, constituents, reaction conditions and so forth used in the specification and claims are to be understood as being modified in all instances by the term "about". Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical value, however, inherently contain certain errors necessarily resulting from the standard deviation found in their respective testing measurements.

General Description

The present invention provides a system and method for noninvasive functional imaging in small animals to allow studies in the development of new radiopharmaceuticals, assessment of new therapeutic approaches, and investigation of fundamental biological processes in mice, rats, and other small animal species, including transgenic and knockout animals. In addition, the present invention allows serial and repeat imaging studies in the same animal at multiple time points to investigate tumor growth, tissue pathology, the effects of therapy, and the mechanism of action of new diagnostic and therapeutic agents. By providing high-resolution imaging capabilities of at least down to about 100 μm, using grazing incidence x-ray and/or γ-ray optics, the present invention can advance our understanding of biology, including human growth, development, and disease.

As examples, in the study of cancer biology, the present invention can enable an operator to follow tumors in their earliest stage of formation, monitor tumor phenotype, quantify invasion or metastasis, or visualize in vivo the action of anticancer therapeutic agents. Such radionuclide imaging can be used as a tumor-specific molecular probe to visualize and quantify tumor growth and regression during therapy. In addition, because of the high spatial resolution of at least down to about 100 μm, the apparatus disclosed hereinafter can identify more specifically the site of action, and can delineate the response of different cell types in tumors that are known generally to be highly heterogeneous in terms of their histopathology.

For neurological studies, the high-resolution imaging of the present invention can address the role of apoptosis in neuronal cell loss and associated neurological deficits that follow traumatic brain injury. In addition, the high-resolution x-ray and/or γ-ray imaging apparatus of the present invention has a role in studying the viability and function of striatal grafts using embryonic cells as a model for neural transplantation in Huntington's disease and Parkinson's disease currently performed with Positron Emission Tomography (PET).

In cardiovascular studies, the invention provides an important tool for assessing perfusion (e.g., a liquid pouring through), metabolism, angiogenesis, and other physiological processes in the murine (i.e., pertaining to mice or rats) myocardium and other tissues.

The apparatus and method illustrated herein after can facilitate classifying and characterizing phenotypes for mapping the genes responsible for normal and abnormal development of tissues or organ systems in the animal. The present invention additionally allows microscopic studies that involve the progression of ischemia (e.g., blockage of a blood vessel) from the endocardial (i.e., situated or occurring within the heart) to epicardial (i.e., on the surface of the heart) surfaces, the evolution of traumatic events associated with vulnerable coronary plaque, and the specific role of the sympathetic nervous system in the evolution of cardiomyopathy (e.g., heart disease).

Specific Description

Turning now to the drawings, a diagram that illustrates a fundamental embodiment of an imager system 100, constructed in accordance with the present invention is shown in FIG. 1A.

A subject 10, such as, an animal or human, e.g., any animal, more often a warm-blooded small animal, from a member of the class Mammalia, such as, but not limited to, mice, rats, dogs, cats, hamsters, pigs, monkeys and guinea pigs, etc., is arranged about an optical axis Z of system 100. However, a tissue sample or other biological sample from an animal, or other members of the class Mammalia, such as, but not limited to, a human or animals large in comparison with the example small animals listed above, such as, apes, horses, etc., can additionally be arranged as a subject 10 and positioned about an optical axis Z and imaged by the present invention.

An example animal subject 10 can be situated in a holder (not shown) either in a horizontal plane (i.e., a small animal's normal, e.g. 4-legged, walking position) or upright in a vertical position to allow imaging in a projection mode in which an optic 20 is focused on a specific location in a stationary subject 10. In another projection mode arrangement, subject 10 remains stationary while optic 20 is translated across subject 10 along one of the directional arrows, e.g., X or Y, shown in FIG. 1A while a detector 38 records images. As another example projection mode arrangement, subject 10 is translated across a field of view of optic 20 along similar denoted directional lines while detector 38 records images. In a pair of tomographic example configurations, subject 10 is rotated (up to 360 degrees) about the denoted directional arrows while being imaged with a stationary optic 20, or subject 10 can remain stationary while optic 20 rotates up to 360 degrees about similar denoted directional arrows while images are recorded.

Subject 10 is administered with a small amount of a radionuclide, i.e., a radioactive material, often by injection, inhalation or by allowing subject 10 to swallow the radionuclide, but more often the subject is intravenously injected with the radioactive material in ways known in the art so as to accumulate in a target tissue or organ of interest. The radionuclide, such as, but not limited to, $^{125}$I, $^{111}$In, $^{96}$Tc, $^{95}$Tc, $^{99m}$Tc, $^{123}$I, $^{124}$I, $^{201}$Tl, $^{131}$I, $^{47}$Sc, $^{67}$Cu, $^{188}$Re, $^{67}$Ga, $^{79}$Kr, $^{82}$Rb, $^{82}$Sr, $^{83}$Sr, $^{85}$Sr, $^{113}$Sn, $^{115}$Cd and $^{199}$Au, emits radiation 14 (shown with arrows in FIG. 1A) in the gamma (γ) or x-rays, and are capable of being collected and directed by a grazing-incidence optic 20 and recorded by detector 38.

Optic 20 can include up to about two hundred nested shells, e.g., 22 and 24, each having collective parabolic 30, and hyperbolic 32, sub-optics arranged to those skilled in the art as modified back-to-back Wolter I (Wolter 1952) grazing incidence telescopes. It is to be appreciated that between about 2 and about 12 sub-optics, each having lengths between about 15 mm and about 200 mm, more often 30 mm, can be employed into each shell of a plurality of nested shells of up to a hundred in the present invention. Optic 20 of the present invention thus operates as a pair of telescopes having a focal length between about 50 and about 200 cm, more often 120 cm, with a field of view of about 8 mm and an edge field of view of up to about 20 cm, to produce a real and inverted image of subject 10 located at an image plane 34 (i.e., position of the array elements of detector 38). The image of subject 10, contains the location of the administered radionuclide emitting photons with an energy of up to about 150 keV, more often between about 27.2 and about 31 keV, and is capable of being recorded by detector 38, such as, a multi-pixel CCD camera, more particularly a position-sensitive imaging detector capable of providing two-dimensional position information and capable of resolving energies or providing energy discrimination. Such an exemplary detector 38 of the present invention, designed with, for example, a source pixel width of down to at least 50 μm, enables imager system 100 to produce images with a spatial resolution of at least down to about 100 μm with a detection sensitivity of at least down to about $5\times10^{-4}$.

Figure 1B:
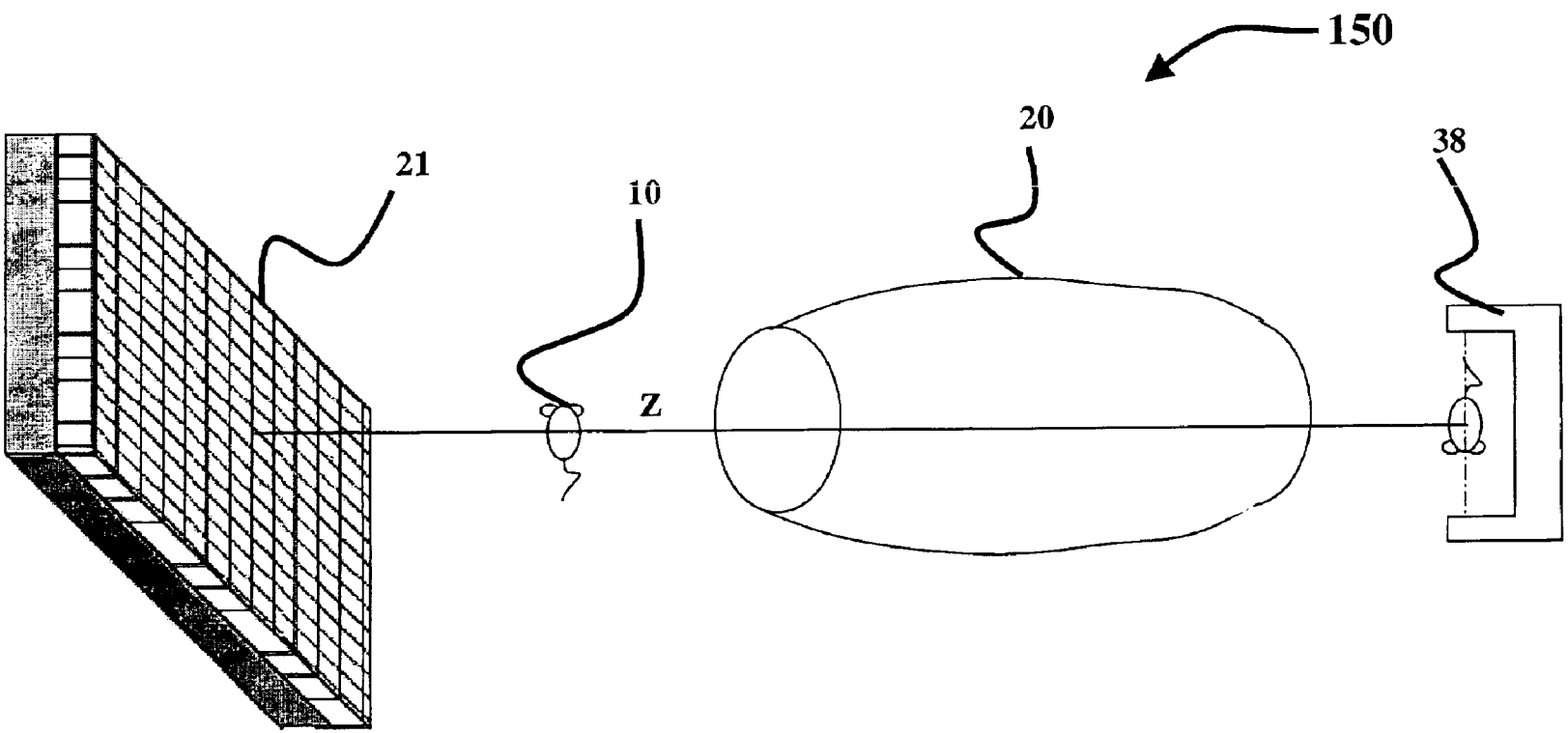
FIG. 1B illustrates an imager embodiment as taught in the present invention that additionally incorporates a low-resolution detector.

FIG. 1B illustrates an imager embodiment 150 of the present invention, wherein imager system 100, as shown in FIG. 1A, is used in combination with one or more conventional low-resolution (e.g., resolutions of down to about 1 mm) radionuclide imaging devices 21, i.e., conventional radionuclide imaging devices known in the art that use pinhole or parallel-hole collimators to image larger regions of the body. In such an arrangement, subject 10, containing a radionuclide, is again situated in a holder (not shown) and aligned along an optic axis, denoted by the letter Z, to allow a localized region of the radionuclide distribution to be targeted. After targeting such a region of interest, optic 20 of the present invention collects and directs γ-rays and/or x-rays to detector 38 to produce high-resolution images of the targeted radionuclide distribution, as discussed above for imager system 100, as shown in FIG. 1A. However, the γ-rays and/or x-rays focused by optic 20 for imaging of subject 10, do not necessarily have to be at the same energies as the γ-rays and/or x-rays detected by low-resolution imaging device 21.

Figure 2:
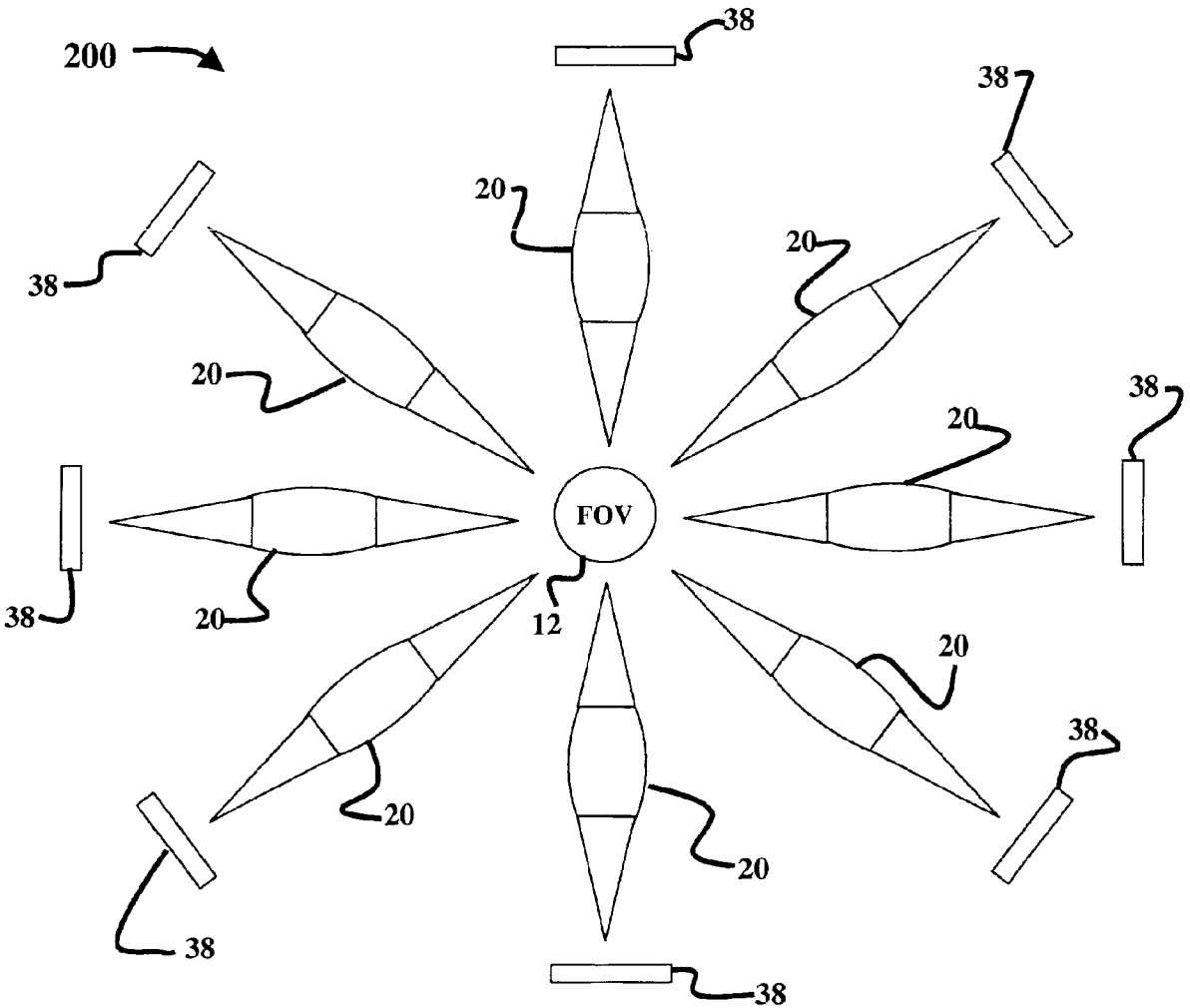
FIG. 2 shows an example of an array of grazing-incidence mirrors arranged in an imager system.

FIG. 2 shows another embodiment of the present invention and is generally designated by the reference numeral 200. In this embodiment, one or more optics 20, as shown in FIG. 1A, are arranged as an array, such as, for example, a hexagonal, a rectangular, or a circular array as shown in FIG. 2, each capable of producing an image of subject (not shown), located within a common field of view 12 (FOV), at a substantially equivalent optical plane such that a respective detector 38, as discussed herein before, can record an image having the location of the radionuclide.

Therefore, similar to imager system 100, shown in FIG. 1A, the array shown in FIG. 2, can be operated in a projection mode, e.g., it can focus on a specific location in a stationary subject 10. Furthermore, subject (not shown) can remain stationary while array of optics 20 is translated across subject (not shown) or subject (not shown) can be translated across a field of view 12 of array of optics 20 along similar denoted directional lines as that shown in FIG. 1A while one or more detectors 38 record images.

For tomographic imaging embodiments, array of imagers 20 are capable of rotating around subject 10 arranged in the centre of common field of view 12 or as another arrangement, the array remains stationary while subject (not shown) rotates about an axis similar to that discussed in the embodiment of FIG. 1A.

Figure 3A:
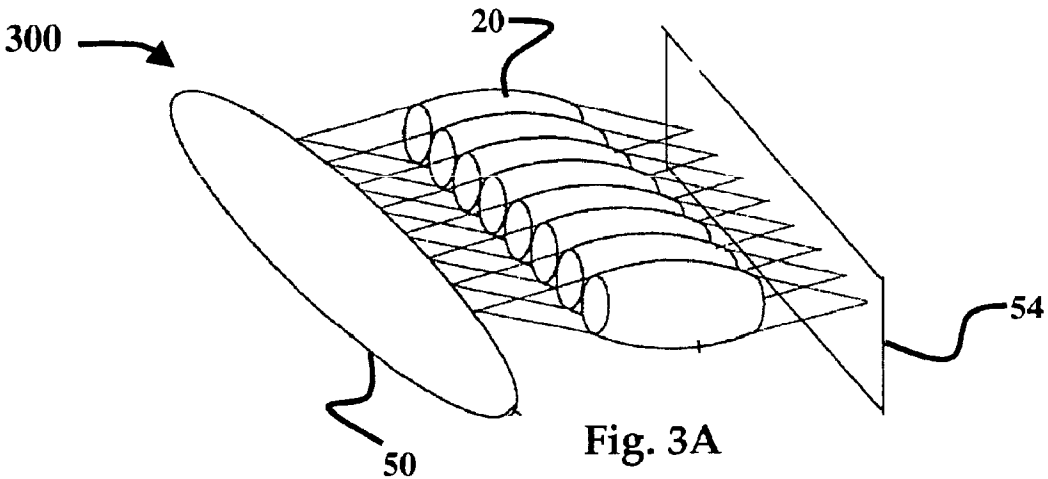
FIG. 3A shows an example of a linear array of grazing-incidence mirrors arranged in an imager system.
Figure 3B:
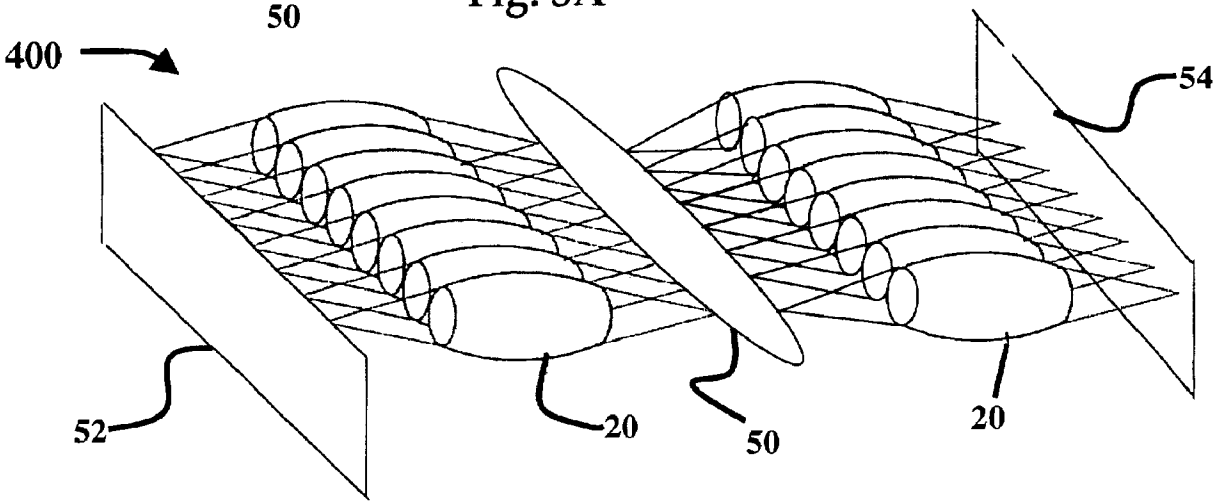
FIG. 3B shows an example of a pair of linear array grazing-incidence mirrors arranged in an imager system.

FIGS. 3A–B illustrates example embodiments designated by the reference numeral 300 and 400 respectively, wherein optic 20 is arranged in a linear array of a plurality of optics such that subject (not shown), located at an object plane 50 is capable of being imaged at an optical plane 52, 54 by one or more detectors (not shown) capable of recording an image having the location of the administered radionuclide either in a similar projection or tomographic mode as discussed above. Specifically, FIG. 3A shows how a single linear array of optics 20 can be arranged to image a larger field of view (FOV) of a subject (not shown) to one or more detectors (not shown), similar to the single optic 20 embodiment discussed in FIG. 1A.

FIG. 3B, illustrates imaging of a subject (not shown) located within a common FOV (i.e., object plane 50) of a pair of linear arrays of multiple optics 20. Such linear arrays, as shown in FIG. 3A can be further arranged as a geometrical array, such as, for example, a rectangular, a circular, and/or a hexagonal array, of linear arrays, each capable of producing an image of subject (not shown), located within a common field of view at a substantially equivalent optical plane, such that a respective detector, as discussed herein before, can record an image having the location of the radionuclide.

Figure 4B:
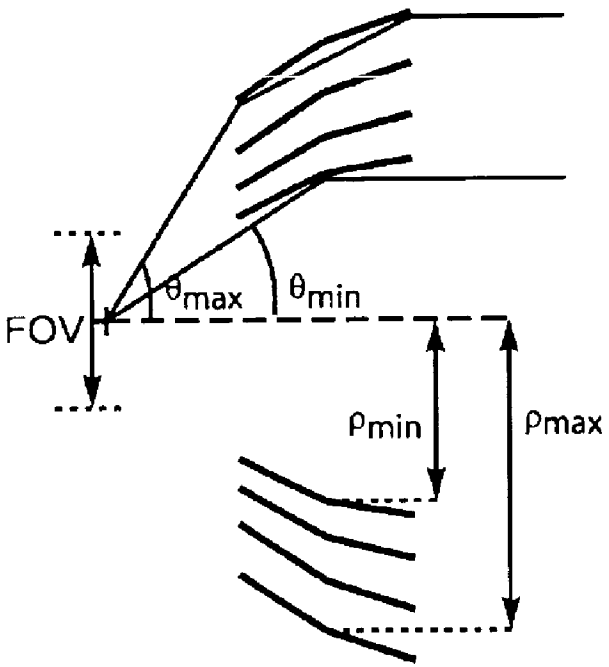
FIG. 4B illustrates basic geometries and parameters of the imager system disclosed in the present invention.
Figure 4A:
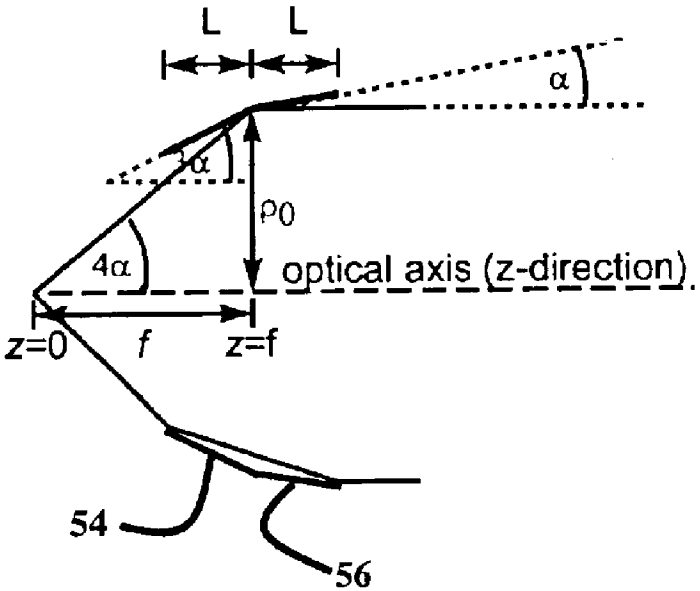
FIG. 4A illustrates basic geometries and parameters of the imager system disclosed in the present invention.

FIGS. 4A–B illustrates basic geometries and parameters integral in the design of example imager system 100, as shown in FIG. 1A. FIG. 4A, which is based on a single layer Wolter I grazing incidence telescope, shows an embodiment defined along the z axis that illustrates a single shell (i.e. a shell means a single surface of revolution) two sub-optic device (i.e., a sub-optic is a reflective element) with each sub-optic 54, 56 having a length between about 15 mm and about 200 mm, more often 30 mm, denoted by the letter L. By contrast, FIG. 4B illustrates a four nested shell, two sub-optic device and imager system 100, as shown in FIG. 1A, is an example of a nested two shell device, with each shell containing four sub-optics.

Also shown in FIG. 4A, is a focal length f defined as the distance along the z optical axis between a point focus, denoted as z=0, and the intersection of an example hyperbolic surface 54 and an example parabolic surface 56. It is given by the expression:

$$f=\rho_0/\tan 4\alpha,$$

where $\rho_0$, having a minimum radius $\rho_{min}$ down to about 15 mm, and a maximum radius $\rho_{max}$ up to about 200 mm, each shown respectively in FIG. 4B, is the radius of the mirrors at their intersection, as denoted in FIG. 4A, and $\alpha$ is a graze angle to parabolic surface 56 at the intersection position. The design thus includes one or more nested shells of conic surfaces, such as parabolic or hyperbolic surfaces, or other small deviations from conic surfaces, and confocal mirrors arranged so that the conical sections, i.e., 54, 56 as shown in FIG. 4A have the z optic axis as their axis of symmetry, and they are also confocal because their images overlap, and the detector only records one image. However, although conic shells such as parabolic and hyperbolic surfaces are often used in the present invention, modifications (e.g. adding slight curvatures to existing curvatures, ellipsoidal surfaces, polynomial surfaces, and combinations thereof) to the mirror shapes can also be employed to conform to design parameters chosen for a given application.

A graze angle $\alpha$, as shown in FIG. 4A, of up to about 1 degree for the present invention, is defined as the angle between an incident ray and a reflecting surface, such as, sub-optics 54 and 56. It is the complement of the angle of incidence used in normal optics design. When an x-ray or $\gamma$-ray reflects from a surface, it undergoes a change in direction of travel of $2\alpha$. The $4\alpha$ dependence of the focal length follows from the fact that two reflections are used to deflect the diverging beam from the source to a parallel beam. By contrast, FIG. 1A shows that an additional two reflections are used to focus the light at image plane 34. Thus, the distance from the source (i.e., subject 10) to detector 38 is 2f, with f designed between about 50 and about 200 cm, more often 120 cm, for the embodiment geometry shown in FIG. 1A. Such a system may be designed to have a magnification of unity, i.e., the image at image plane 34 is the same size as subject 10. By using fewer or more than 4 sub-optics, as shown in FIG. 4A, or by changing the shape of the sub-optics from parabolas and hyperbolas, any arbitrary magnification can be achieved.

A spot size refers to the size of the image at the image plane of a point source in the Field of View (FOV) denoted in FIG. 4B. A FOV is the distance a source can move from the optical axis before the throughput of the imager drops to a predetermined level of about 15% of the on-axis throughput. For parameters chosen for the present invention, a FOV of up to about 8 mm and an off-axis edge FOV capability of up to about 20 cm is capable of being achieved.

FIG. 4B also illustrates that a solid angle $\Omega$ subtended by the optic depends primarily on the range of rays that enter the optic. Using spherical co-ordinates, it can be shown that $\Omega=g\times[\cos\theta_{min}-\cos\theta_{max}]/2$, where $\theta_{max/min}$ are the maximum and minimum angles subtended by the optic. These are related to the maximum/minimum graze angles $\alpha_{max/min}$ by $\theta_{max/min}=4\alpha_{max/min}$. Using the small-angle approximations of the cosine, the solid angle expression simplifies to: $\Omega=(g/2)\times[\theta^2_{min}-\theta^2_{max}]$, where the angles are expressed in radians and g, the obscuration, accounts for light blocked by the non-reflecting surfaces of the optic and depends on the thickness and length, L of the shells as well as the geometry of mounting fixtures and spacers, wherein g varies between about 0.2 and about 1.0.

To enhance the efficiency of the imager, one can apply multi-layer films to the reflecting surfaces. Just as multi-layers can affect the transmission or reflection of optical light, the present invention provides a plurality of sub-optics each having a graded depth (e.g., the alternating layer pairs get thinner with depth) of alternating layers of high and low index of refraction materials, such as Tungsten (W) over Silicon (Si), Tungsten (W) over Carbon (C), Molybdenum (Mo) over Boron Carbide ($B_4C$), and Nickel (Ni) over Carbon (C), or other combinations as known to those skilled in the art, to provide a broad reflectance angular response for a range of grazing angles up to a maximum grazing angle of about 1.00 degrees. However, other multi-layer designs, such as, a graded depth with an increasing thickness with depth for the layer pairs or variations thereof are also capable of being employed within the design parameters of the present invention.

Figure 5:
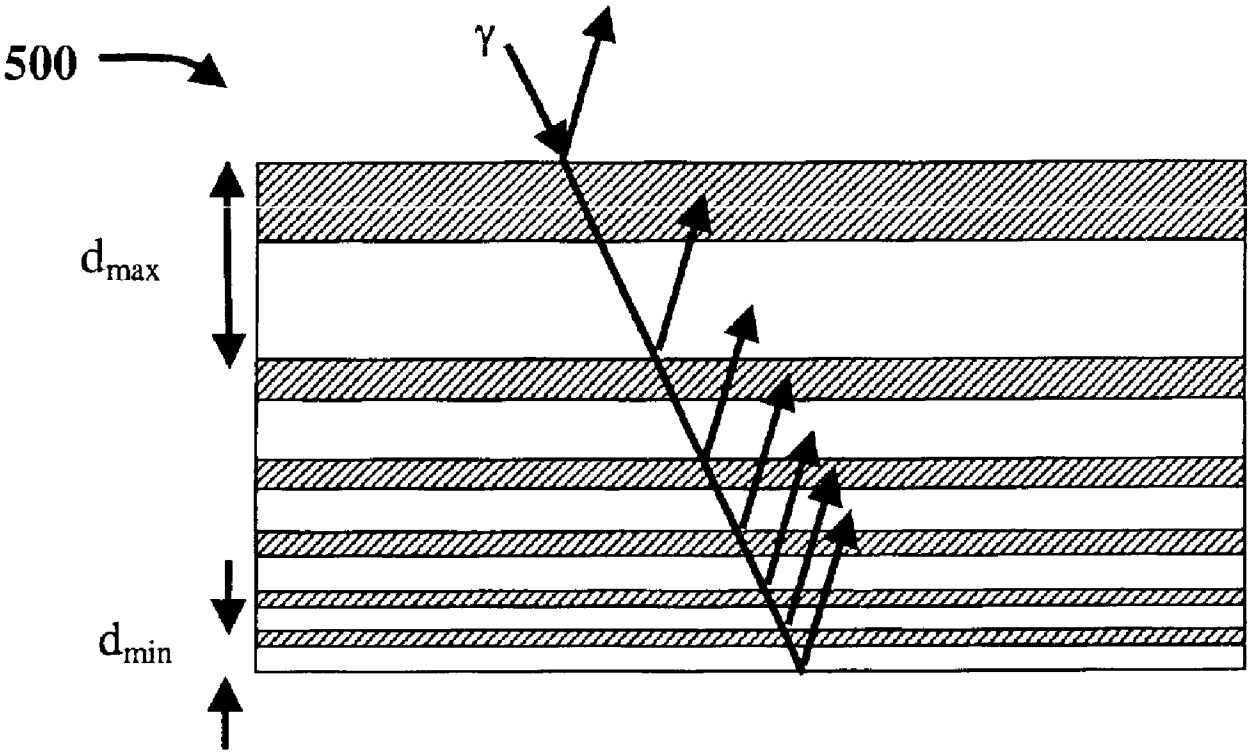
FIG. 5 shows an example schematic of a graded depth multi-layer coating.

FIG. 5 illustrates the graded depth multi-layer coating of the invention, designated by the reference numeral 500.

Such a coating can include a maximum spacing, shown as $d_{max}$, of at least about 30 angstroms and a minimum spacing, denoted as $d_{min}$, of down to about 5 angstroms, designed by ray tracing codes to enable incident electromagnetic rays, such as γ-rays, shown by the arrow and denoted as γ, to be exposed to a wide range of layer spacings. The present invention is capable of utilizing a graded depth multi-layer coating pair in up to about 300 bi-layer pairs on up to 100 or more shells. In addition, as another embodiment, the present invention can utilize a unique multi-layered coating for different shells. For instance, every third shell to produce an imager having 26 unique layer pairs for up to 79 shells to provide a high throughput response of the imager to at least about 50%.

The optics are built using substantially flat materials, such as, but not limited to, silica, plastic, sapphire, and glass, such as, for example, about a 210 μm thick, Desag D263 glass, developed for the electronics industry to manufacture flat panel notebook computer displays. Such an example material, as supplied from the manufacturer, has about a 3 angstrom RMS surface roughness, which reduces losses due to scatter. The sheets are thermally slumped to produce optics with about a 10 arc second figure to approximate the surface of revolution of a single shell, i.e., the shape of each shell is described by a surface of revolution of a straight line (i.e., a cone,) or a more complicated line (i.e. a conic, such as, for example, a hyperboloid or a paraboloid, or a higher order polynomial expression.) The slumped glass is coated with a graded-depth multilayer to enhance reflectivity, trimmed to the final shape and then mounted on a sub-optic. Each shell is made of a number of pieces. The number is selected based on the performance of the slumped section and the ability to produce a uniform multilayer coating over the inside surface of the arc. For example, a two-shell optic may use five pieces to make up each full shell, i.e., ten total pieces.

Figure 6B:
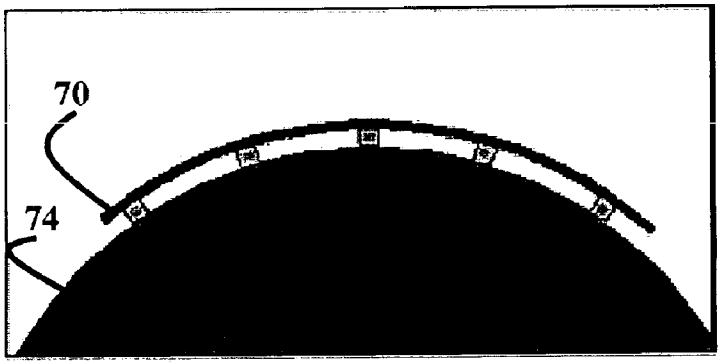
FIG. 6B illustrates a step in the assembly process for the grazing incidence mirrors, wherein a glass segment is glued down and forced to conform to the shape of the graphite spacers.
Figure 6A:
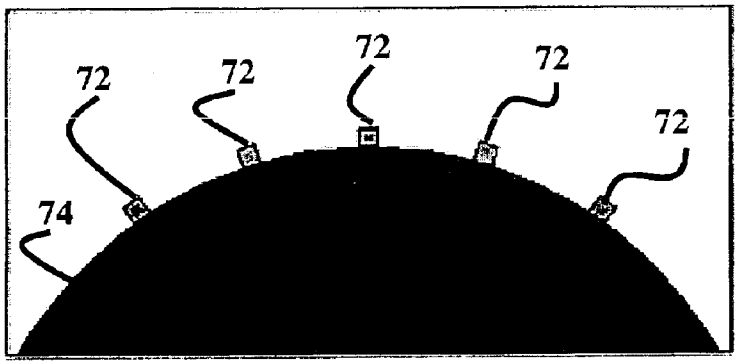
FIG. 6A illustrates a step in the assembly process for the grazing incidence mirrors, wherein graphite spacers are attached around the circumference of the back of the previous optics shell.
Figure 6D:
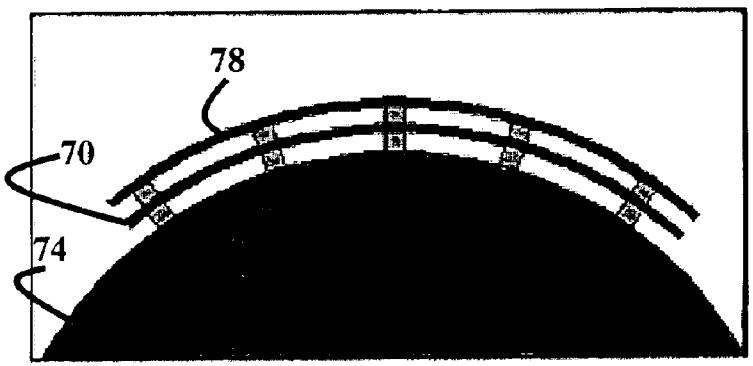
FIG. 6D illustrates a step in the assembly process for the grazing incidence mirrors, wherein a final shell is added.
Figure 6C:
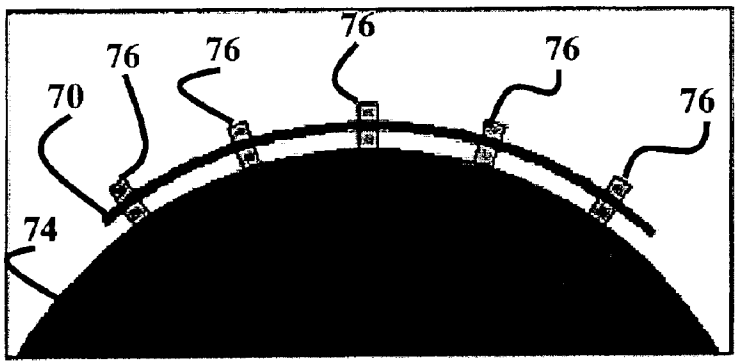
FIG. 6C illustrates a step in the assembly process for the grazing incidence mirrors, wherein a new set of graphite spacers are attached to the back of the previous shell and the process is repeated.

The assembly process is shown in FIGS. 6A–D. A formed piece 70, as shown in FIGS. 6B–D is fixedly attached with, for example, glue or epoxy, to about 1-mm square graphite spacers 72, as shown in FIG. 6A, that are also attached with, for example, glue or epoxy, to about 25 points around the circumference of a mandrill 74 that the optic is built around. Before the glass is applied, the graphite spacers 72 are machined to the precise figure required for the shell being mounted. As the glass segment, i.e., formed piece 70, is glued down, as shown in FIG. 6B, pressure is applied to force it to conform to the shape of the spacers 72, and hence the desired shape of the optic. After the glue cures, a new set of spacers 76, as shown in FIG. 6C, are attached to the back of the previous shell 70 and the process is repeated until the last shell 78, as shown in FIG. 6D is added. Such a technique of the present invention can typically produce up to about 40" multiple-reflection optics.

A two-dimensional high resolutionexample detector of the present invention can be arranged as a hybrid detector that includes an Application Specific Integrated Circuit (ASIC). Examples of different ASICs already built or currently under development can be found in the literature. For medical instruments, large companies such as Siemens, Philips, and General Electric, have their own specific front-end circuits. At the European Center for Nuclear Research, ASICs have been developed or are under development for DELPHI, OPAL, L3, ALEPH, NA48, CMS, and ATLAS experiments. In the context of the research and development program at CERN, several ASICs are under development, such as RD27 and RD16 (digital front-end readout micro-system for calorimetry at LHC, Fermi, etc.).

An example ASIC of the present invention contains read-out electronics bonded to a sense material. The sense material, such as, for example, silicon (Si), lithium-drifted silicon Si(Li), high-purity Germanium (Ge), Cadmium Zinc Telluride (CZT) and Cadmium Telluride (CdTe), each having a thickness of up to about 500 microns, can convert gamma-rays into charge carriers, and is bonded to the chips using, as one example, an indium bump-bonding technique. In this process, small indium nodules are placed on the input pads of the readout chips and on one side of the sense material, which has been patterned with an electrode structure to match the pitch of the pixel detector. The two parts are aligned so that the indium bumps line up and the two are pressed together. The indium fuses to make the electrical connection between the sense material and the bump-bonding technique. As radiation, such as, γ-rays penetrates the sense material, it leaves behind an ionization trail. The ionization charge is collected with an applied electric field and passed to the readout ASIC chip via the closest bump bond. Operationally connected backend circuitry then can process the signals into a simple stream of event locations for all events that fall into a selectable, narrow energy window of, for example, about 1 keV in width.

In addition to the semi-conductor detector examples listed above, i.e., silicon (Si), lithium-drifted silicon Si(Li), high-purity Germanium (Ge), Cadmium Zinc Telluride (CZT) and Cadmium Telluride (CdTe) sensor materials, other materials, such as, but limited to, lead iodide or mercuric iodide coupled to an amorphous silicon or a CMOS read-out device, constructed to the design parameters for the detector, can also be employed in the present invention. Moreover, the radiation detector can additionally be configured as light-sensitive photodetectors, such as, silicon photodiodes (Si) or photomultiplier tubes that are optically coupled to a converter material or a scintillator, such as, but not limited to, thallium-doped sodium-iodide (NaI(Tl)), thallium-doped cesium iodide (CsI(Tl)), lutetium orthosilicate (LSO), sodium-doped cesium iodide CsI(Na), lanthanum bromide, lanthanum chloride, or bismuth germinate (BGO) that can convert gamma-rays into light photons. The light photons emitted as a consequence of absorption of the gamma-ray then are recorded by the optical detector which produces electronic charge that is passed to the readout.

A data acquisition system coupled with image processing software then can process the recorded events. Such a system utilizes, for example, a custom readout board coupled through VME/VXI to a personal computer. The system is portable and uses as one embodiment a commercial graphical user interface to enable customized C or C++ code for efficient data transfer, analysis and visualization.

For planar imaging, a single set of projection data can be acquired in, for example, a 512×512 matrix, in a configuration in which both the animal and the imaging detector are stationary or are translating in a rectilinear motion with respect to one another. Images then are formed or reconstructed by accumulating events corresponding to the recorded γ-rays in a way that maps a specific location on or in the object to specific elements in the image matrix using a one-to-one relationship.

For tomographic imaging, projection data can be acquired in, for example, a 512×512 matrix at a radius of rotation suitable for focusing radiation, such as, γ-rays, onto a detector of the present invention. Images can then be reconstructed using, for example, analytical (i.e., Feldcamp) or iterative (i.e., maximum-likelihood expectation-maximization) algorithms.

Accordingly, it has thus been shown that the present invention provides a high-resolution imaging method and system for noninvasive functional imaging in small animals. The system utilizes grazing-incidence x-ray and γ-ray optics to produce images with a spatial resolution of at least down to about 100 μm with a detection sensitivity of at least down to about $5\times10^{-4}$.

It should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An imaging apparatus, comprising:

a subject arranged as a radiopharmaceutical source of emitting particles; and at least one grazing incidence focusing optic configured to direct the emitting particles onto at least one detector, wherein a real and inverted image of the location of the radiopharmaceutical is capable of being constructed.

2. The apparatus of claim 1, wherein a plurality of predetermined images are produced as the subject rotates about a predetermined axis.

3. The apparatus of claim 1, wherein an array of grazing incidence focusing optics are arranged to produce a plurality of predetermined images as the array rotates about a common axis of rotation.

4. The apparatus of claim 3, wherein the array comprises one of a circular array, a rectangular array, and a hexagonal array.

5. The apparatus of claim 4, wherein a plurality of predetermined images are produced as the subject rotates about an axis arranged in the center of a common field of view.

6. The apparatus of claim 1, wherein the radiopharmaceutical includes a radio-isotope used to label pharmaceuticals.

7. The apparatus of claim 6, wherein the radiopharmaceutical comprises at least one from $^{125}$I, $^{111}$In, $^{96}$Tc, $^{95}$Tc, $^{99m}$Tc, $^{123}$I, $^{124}$I, $^{201}$Tl, $^{131}$I, $^{47}$Sc, $^{67}$Cu, $^{188}$Re, $^{67}$Ga, $^{79}$Kr, $^{82}$Rb, $^{82}$Sr, $^{83}$Sr, $^{85}$Sr, $^{113}$Sn, $^{115}$Cd and $^{199}$Au.

8. The apparatus of claim 1, wherein the subject includes a warm-blooded animal comprising one from mice, rats, dogs, cats, hamsters, pigs, monkeys and guinea pigs.

9. The apparatus of claim 1, wherein the subject includes a tissue sample from a warm-blooded animal.

10. The apparatus of claim 1, wherein a detection sensitivity of at least down to about $5\times10^{-4}$ is capable of being achieved.

11. The apparatus of claim 10, wherein the detector includes a spatial resolution of at least down to about 50 μm.

12. The apparatus of claim 11, wherein the detector provides two-dimensional position information and energy.

13. The apparatus of claim 12, wherein the detector includes a position sensitive semiconductor material.

14. The apparatus of claim 13, wherein the semiconductor material comprises one from silicon (Si), lithium-drifted silicon Si(Li), high-purity Germanium (Ge), Cadmium Zinc Telluride (CZT) and Cadmium Telluride (CdTe).

15. The apparatus of claim 12, wherein the detector includes a light sensitive photodetector coupled to a converter material.

16. The apparatus of claim 15, wherein the detector includes a scintillator.

17. The apparatus of claim 16, wherein the converter material comprises at least one from thallium-doped sodium-iodide (NaI(Tl)), thallium-doped cesium iodide (CsI(Tl)), sodium-doped cesium iodide CsI(Na), lutetium orthosilicate (LSO), lanthanum bromide, lanthanum chloride, and bismuth germinate (BGO).

18. The apparatus of claim 16, wherein the converter material comprises at least one from thallium-doped sodium-iodide (NaI(Tl)), thallium-doped cesium iodide (CsI(Tl)), sodium-doped cesium iodide CsI(Na), lutetium orthosilicate (LSO), lanthanum bromide, lanthanum chloride, and bismuth germinate (BGO).

19. The apparatus of claim 1, wherein a maximum grazing incidence-angle is up to about 1.00 degrees.

20. The apparatus of claim 1, wherein the emitted particles include γ-rays and/or x-rays having an energy of up to about 150 keV.

21. The apparatus of claim 1, wherein the optic is a reflector that comprises one or more concentric nested conic shells arranged with a common axis of symmetry and wherein the shape of each shell is described by a surface of revolution of a straight line.

22. The apparatus of claim 21, wherein the nested conic shells include hyperbolic and parabolic shells arranged to form an image at a common optical plane.

23. The apparatus of claim 21, wherein a plurality of emitted particles are capable of being reflected between about 2 and about 12 times throughout each of the shells.

24. The apparatus of claim 23, wherein the shells include a plurality of sub-optics each having a graded depth multilayer coating.

25. The apparatus of claim 24, wherein the coating includes alternating high and low index materials of up to about 300 bi-layers.

26. The apparatus of claim 25, wherein the alternating high and low index materials include at least one pair from W/Si, W/C, Mo/$B_4$C, and Ni/C.

27. The apparatus of claim 25, wherein a substrate material for the coating includes a substantially flat material comprising one from glass, plastic, silica, and sapphire.

28. The apparatus of claim 1, wherein images are recorded in a projection mode arrangement.

29. An imaging apparatus, comprising:

a subject arranged as a radiopharmaceutical source of emitting particles; and at least one linear array of grazing incidence focusing optics configured to direct the emitting particles onto at least one high resolution detector, wherein a real and inverted image of the location of the radiopharmaceutical is capable of being constructed.

30. The apparatus of claim 29, wherein a plurality of predetermined images are produced as the subject rotates about a predetermined axis.

31. The apparatus of claim 29, wherein a geometrical array of linear array grazing incidence focusing optics are capable of producing a plurality of predetermined images as the array rotates about a common axis of rotation.

32. The apparatus of claim 31, wherein a plurality of predetermined images are produced as the subject rotates about an axis arranged in the center of a common field of view.

33. The apparatus of claim 31, wherein the geometrical array comprises one from a circular array, a rectangular array, and a hexagonal array.

34. The apparatus of claim 29, wherein the radiopharmaceutical includes a radio-isotope used to label pharmaceuticals.

35. The apparatus of claim 34, wherein the radiopharmaceutical comprises at least one from $^{125}$I, $^{111}$In, $^{96}$Tc, $^{95}$Tc, $^{99m}$Tc, $^{123}$I, $^{124}$I, $^{201}$Tl, $^{131}$I, $^{47}$Sc, $^{67}$Cu, $^{188}$Re, $^{67}$Ga, $^{79}$Kr, $^{82}$Rb, $^{82}$Sr, $^{83}$Sr, $^{85}$Sr, $^{113}$Sn, $^{115}$Cd and $^{199}$Au.

36. The apparatus of claim 29, wherein the subject includes a tissue sample from a warm-blooded animal.

37. The apparatus of claim 29, wherein the subject includes a warm-blooded animal comprising one from mice, rats, dogs, cats, hamsters, pigs, monkeys and guinea pigs.

38. The apparatus of claim 29, wherein a detection sensitivity of at least down to about $5\times10^{-4}$ is capable of being achieved.

39. The apparatus of claim 38, wherein the high-resolution detector includes a spatial resolution of at least down to about 50 $\mu$m.

40. The apparatus of claim 39, wherein the high-resolution detector provides two-dimensional position information and energy.

41. The apparatus of claim 40, wherein the detector includes a position sensitive semiconductor material.

42. The apparatus of claim 41, wherein the semiconductor material comprises one from silicon (Si), lithium-drifted silicon Si(Li), high-purity Germanium (Ge), Cadmium Zinc Telluride (CZT) and Cadmium Telluride (CdTe).

43. The apparatus of claim 40, wherein the detector includes a light sensitive photodetector coupled to a converter material.

44. The apparatus of claim 43, wherein the detector includes a scintillator.

45. The apparatus of claim 29, wherein a maximum grazing-incidence angle is up to about 1.00 degrees.

46. The apparatus of claim 29, wherein the emitted particles include γ-rays and/or x-rays having an energy up to about 150 keV.

47. The apparatus of claim 29, wherein the array includes a plurality of reflecting optics, each having one or more concentric nested conic shells arranged with a common axis of symmetry and wherein the shape of each shell is described by a surface of revolution of a straight line.

48. The apparatus of claim 47, wherein the nested conic shells include hyperbolic and/or parabolic shells, and/or other small deviations from conic surfaces, arranged to form an image at a common optical plane.

49. The apparatus of claim 48, wherein the shells include a plurality of sub-optics each having a graded depth multi-layer coating.

50. The apparatus of claim 49, wherein the coating includes alternating high and low index materials of up to about 300 bi-layers.

51. The apparatus of claim 50, wherein the alternating high and low index materials include at least one pair from W/Si, W/C, Mo/$B_4C$, and Ni/C.

52. The apparatus of claim 50, wherein a substrate material for the coating includes a substantially flat material comprising one from glass, plastic, silica, and sapphire.

53. The method of claim 52, wherein images include a projection mode arrangement.

54. The apparatus of claim 29, wherein images are recorded in a projection mode arrangement.

55. An imaging apparatus, comprising:

a subject arranged as a radiopharmaceutical source of emitting particles along an optic axis, a low-resolution position sensitive detector arranged along the optic axis, wherein the location of the radiopharmaceutical is targeted by a constructed low-resolution image; and at least one grazing incidence focusing optic configured to direct the emitting particles having a same and/or different emission line spectrum as detected by the low-resolution detector, onto at least one high-resolution detector, wherein a high-resolution real and inverted image of the targeted radiopharmaceutical is capable of being constructed.

56. The apparatus of claim 55, wherein the low-resolution detector is arranged to produce position-sensitive low-resolution images of down to about 1 mm such that a region of interest is capable of being targeted.

57. A non-invasive imaging method, comprising:

administering to a subject a radiopharmaceutical capable of emitting particles, directing the emitted particles with at least one grazing-incidence focusing optic, simultaneously detecting, with respect to a predetermined position between about 0 and about 360 degrees, each emitted x-ray and/or each emitted γ-ray captured by at least one detector; and producing high-resolution real and inverted images of the location of the radiopharmaceutical indicative of each of the predetermined positions.

58. The method of claim 57, wherein the high-resolution images are produced as the subject rotates about a predetermined axis.

59. The method of claim 57, wherein an array of grazing-incidence focusing optics are arranged to produce the high-resolution images as the circular array rotates about a common axis of rotation.

60. The method of claim 59, wherein the high-resolution images are produced as the subject rotates around an axis arranged in the center of a common field of view.

61. The apparatus of claim 57, wherein the radiopharmaceutical includes a radio-isotope used to label pharmaceuticals.

62. The method of claim 61, wherein the radiopharmaceutical comprises at least one from $^{125}$I, $^{111}$In, $^{96}$Tc, $^{95}$Tc, $^{99m}$Tc, $^{123}$I, $^{124}$I, $^{201}$Tl, $^{131}$I, $^{47}$Sc, $^{67}$Cu, $^{188}$Re, $^{67}$Ga, $^{79}$Kr, $^{82}$Rb, $^{82}$Sr, $^{83}$Sr, $^{85}$Sr, $^{113}$Sn, $^{115}$Cd and $^{199}$Au.

63. The apparatus of claim 57, wherein the subject includes a tissue sample from a warm-blooded animal.

64. The method of claim 57, wherein the subject includes a warm-blooded animal comprising one from mice, rats, dogs, cats, hamsters, pigs, monkeys and guinea pigs.

65. The method of claim 57, wherein a maximum grazing-incidence angle is up to about 1.00 degrees.

66. The method of claim 57, wherein the emitted particles include γ-rays and/or x-rays having an energy up to about 31.0 keV.

67. The method of claim 66, wherein the emitted particles are reflected between about 2 and about 12 times throughout the optic.

68. The method of claim 57, wherein the optic is a reflector that comprises one or more concentric nested conic shells arranged with a common axis of symmetry and wherein the shape of each shell is described by a surface of revolution of a straight line.

69. The method of claim 68, wherein the nested conic shells include hyperbolic and/or parabolic shells, and/or shells with other small deviations from conic surfaces, arranged to form an image at a common optical plane.

70. The method of claim 69, wherein the shells include a plurality of sub-optics, each having a graded depth multi-layer coating.

71. The method of claim 70, wherein the coating includes alternating high and low index materials of up to about 300 bi-layers.

72. The method of claim 71, wherein the alternating high and low index materials include at least one pair from W/Si, W/C, Mo/$B_4C$, and Ni/C.

73. The method of claim 71, wherein a substrate material for the coating includes a substantially flat material comprising one from glass, plastic, silica, and sapphire.

74. The method of claim 69, wherein the low-resolution position sensitive detector produces images having a resolution of down to about 1 mm.

75. The method of claim 57, wherein the high-resolution images are produced after a low-resolution position sensitive detector is arranged to target the location of the radiopharmaceutical.

* * * * *